US005309950A

United States Patent [19]

Bassi et al.

[11] Patent Number: 5,309,950

[45] Date of Patent: May 10, 1994

[54] QUICK FASTENING HARNESS CORD CONNECTION

[75] Inventors: Dario Bassi, Venissieux; Alexis Porte, Jons, both of France

[73] Assignee: Staubli-Verdol S.A., Chassieu, France

[21] Appl. No.: 989,146

[22] Filed: Dec. 11, 1992

[30] Foreign Application Priority Data

Dec. 12, 1991 [FR] France ..... 91 15684

[51] Int. Cl.[5] ..... D03C 3/40

[52] U.S. Cl. ..... 139/88; 403/329; 24/616; 24/115 H; 139/85

[58] Field of Search ..... 403/329; 24/3 B, 115 H, 24/129 A, 616; 139/88, 59, 62, 85, 86

[56] References Cited

U.S. PATENT DOCUMENTS 3,789,467 2/1974 Aratani et al. .

3,798,711 3/1974 Cousins ..... 24/616 X 3,967,351 7/1976 Rosenberg et al. ..... 24/616

FOREIGN PATENT DOCUMENTS 627819 8/1949 United Kingdom ..... 139/88

*Primary Examiner*—Andrew M. Falik

*Attorney, Agent, or Firm*—Dowell & Dowell

[57] ABSTRACT

A quick connect coupling for connecting at least one funicular element with respect to the end of a cord, particularly for those of a harness of a weaving loom, to a cord of shed-forming device of the loom, which includes an insert element associated with the cord of the shed-forming device which has at least one crosspiece to which the cord is attached and a bar located below the crosspiece. A clamp is provided for receiving the insert and has two branch elements which are secured to at least one funicular element. The branch elements have hooked free ends which are elastically articulated relative to one another toward the geometrical axis of symmetry of the clamp.

12 Claims, 4 Drawing Sheets

QUICK FASTENING HARNESS CORD CONNECTION

BACKGROUND OF THE INVENTION

1. Field of the Invention

The present invention relates to a quick connect coupling for connecting at least one funicular element with respect to the end of a cord, and more particularly, but not exclusively, to the dismountable connection of the cords of a harness of a weaving loom with respect to the cord of a shed-forming device of the loom.

2. History of the Related Art

Up to the present time, the cords of the hooks of shed-forming devices include a snap fastener which engages in a loop made at the end of the cords of the harness associated therewith. It will be readily understood that, when there is a very large number of hooks, assembly of the harness necessitates connecting a corresponding number of snaps, which, on the one hand, wastes time and, on the other hand, may result in injury of the assemblers' hands.

The improvements forming the subject matter of the present invention are directed to avoiding the two drawbacks mentioned hereinabove and at producing a quick connect coupling which responds better than heretofore to the desidarata of the art.

SUMMARY OF THE INVENTION

To that end, a quick connect coupling is provided, comprising an insert element associated with the cord of the shed-forming device and made in the form of two portions joined by at least one crosspiece to which said cord is attached. The two portions are joined by a bar located opposite the crosspiece. A clamp with two branch elements extending from a base in which is fixed at least one funicular element such as a cord of a harness. The branch elements are articulated on one another near their free ends which each are in the form of a hook oriented towards the geometrical axis of symmetry of the clamp. The intermediate portions of the branches elements being elastic.

The above two elements are preferably made by molding an appropriate plastic material so that their cost price is very low.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
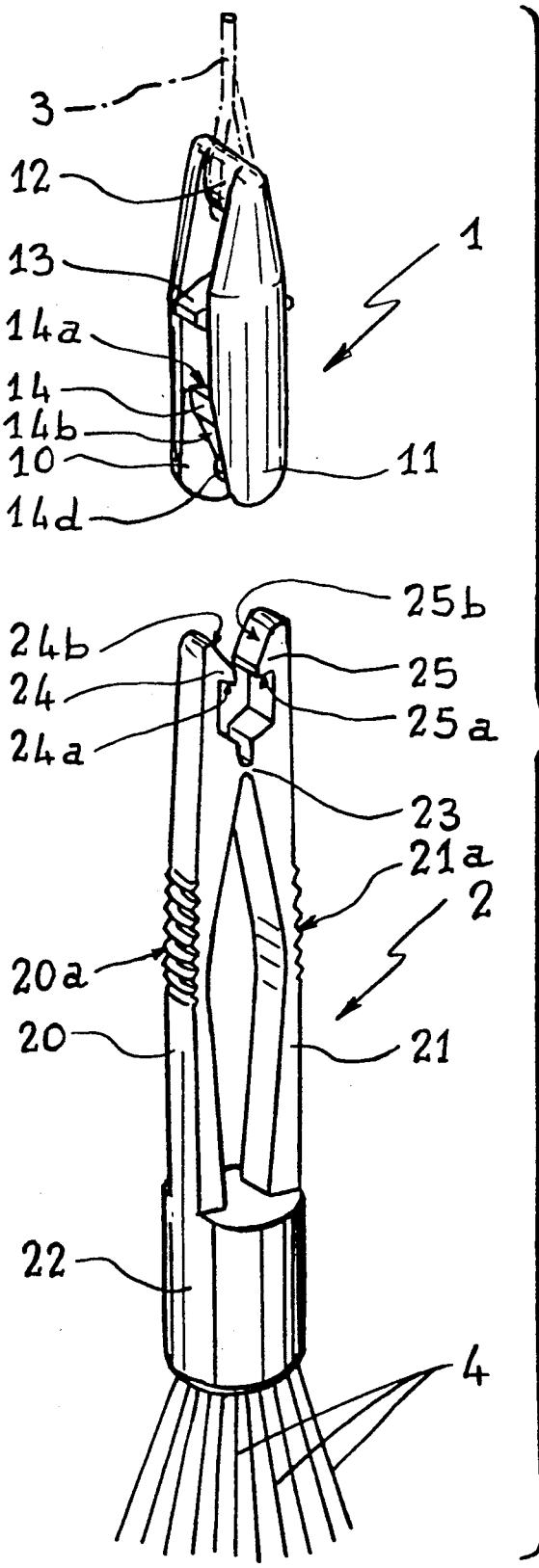
FIG. 1 is an exploded view in perspective of the two elements of the quick connect coupling according to the invention.
Figure 2:
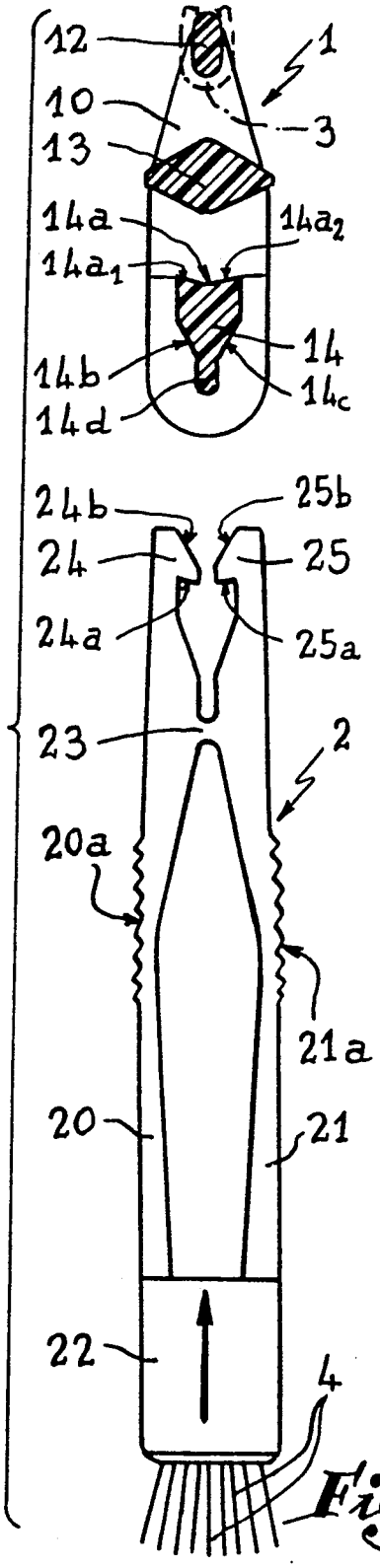
FIGS. 2 to 4 are partial cross-sectional side elevational assembly views showing in step-by-step relationship the assembly of one of the quick connect couplings of the present invention.
Figure 3:
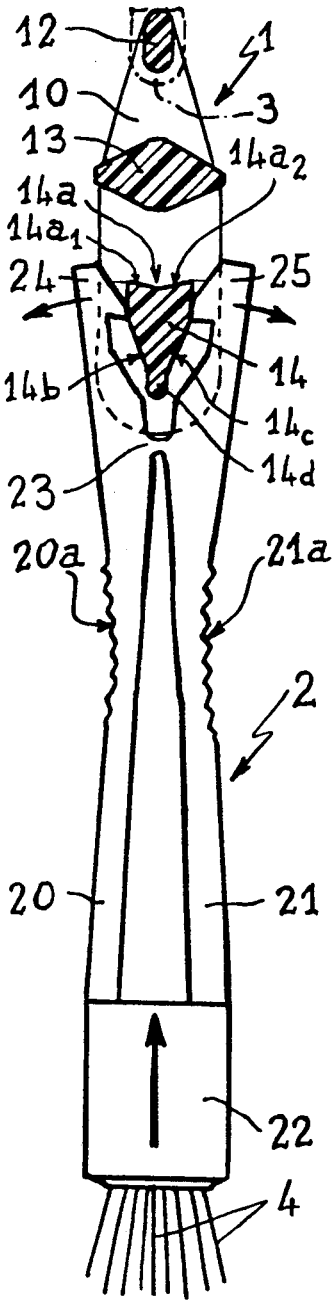

Referring now to the drawings, the quick connect coupling according to the invention includes two elements, an insert element 1 and a clamp 2, which are preferably made by molding an appropriate plastic material, but which may, of course, be manufactured from any other material.

Insert element 1 includes two parallel members 10, 11 joined at one of their ends by a crosspiece 12 around which is knotted a cord 3. The two members 10, 11 are further joined by an intermediate crosspiece 13 and by a bar 14 located at the ends of the members opposite those connected by crosspiece 12.

Clamp 2 includes two branch elements 20, 21 which extend from a tubular base 22 in which is retained at least one funicular element 4 by any appropriate means (not shown). In the example illustrated, a plurality of funicular elements 3 constitutes the cords of a harness for manipulating the heddles which control a opening of the shed of the warp of a weaving loom.

At their free ends, the two branch elements 20, 21 are joined by an flexible 23 which, in the example shown, is a web of plastic material, since the clamp 2 is molded from such a material. The ends of the two branch elements 20, 21 terminate in a hook 24, 25 oriented in the direction of the geometrical axis of symmetry of the clamp, i.e. inwardly, so that the hooks 24 and 25 are located in opposition with each other. It will be observed that branch elements 20, 21 include thinner, striated elastically yieldable intermediate portions **20*a*, 21*a* so that, by applying on each of them a force F1, F2 directed towards the axis of symmetry of the clamp, the hooks 24 and 25** are moved apart.

It will be noted in FIGS. 2 to 6 that the bar 14 of the element 1 includes an inner edge **14*a* in the form of two inclined surfaces $14a_1$ and $14a_2$ forming a V, so that this edge is concave in the direction of the crosspiece 12. From the edge 14*a*, the bar 14 tapers to form two lateral ramps 14*b*, 14*c* which are convergent towards the lower edge of the bar to a thin tongue 14*d* oriented in the direction opposite that of the inner edge 14*a*. The thickness of the tongue 14*d* is less than the distance between the hooks 24, 25. It will be observed in FIG. 1 that the inner surfaces of the members 10, 11 of the element 1 are slightly divergent in the direction opposite that of the crosspiece 12 from the inner edge 14*a* of the crosspiece 14**, for reasons which will be explained hereinbelow.

The engaging faces **24*a*, 25*a* of the hooks 24 and 25 are sloping, converging in the direction of the axis of symmetry of the clamp 2, their inclination being equal to that of the surfaces $14a_1$ and $14a_2$ of the inner edge 14*a* of element 1**.

A clamp has thus been produced with rigid branch elements, which are able to be elastically deformed when there are applied on the median part of these branches forces F1 and F2 in the direction of its axis of symmetry, or when the hooks 24 and 25 are moved apart by an outside force.

Figure 4:
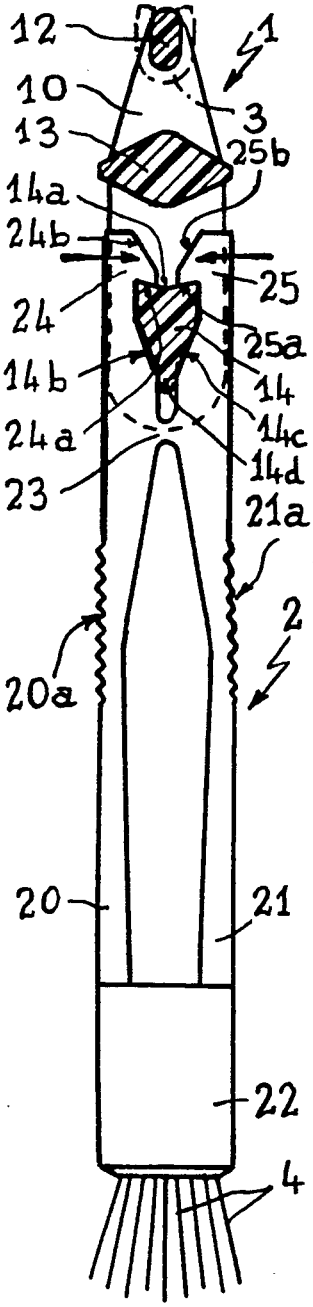
Figure 5:
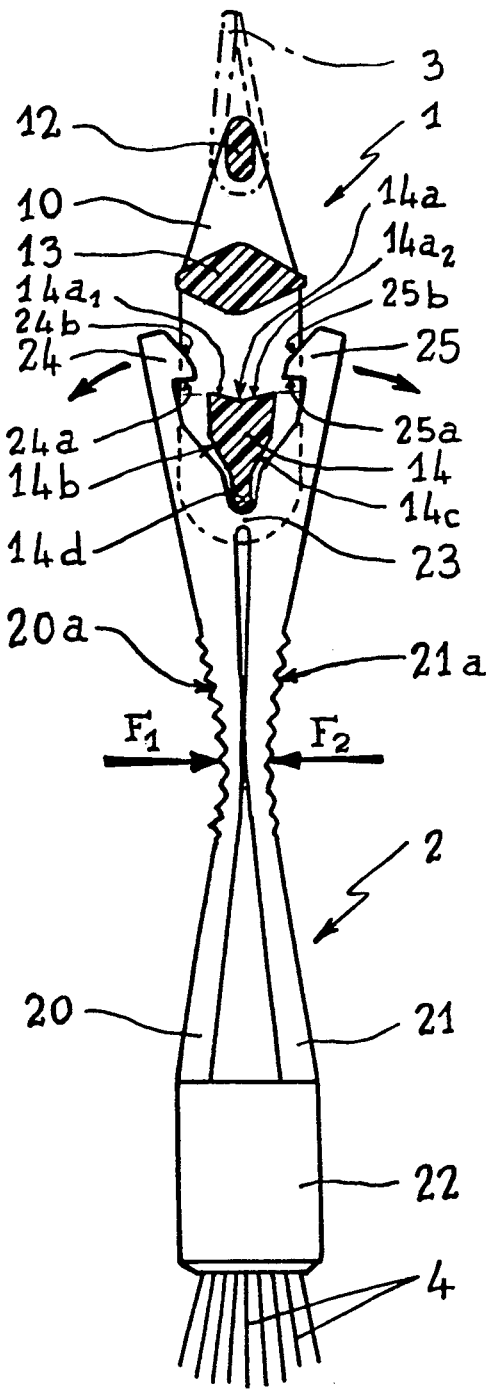
FIGS. 5 and 6 are partial cross-sectional side elevational views showing in step-by-step relationship the disassembly of the quick connect couplings of FIGS. 2–4.
Figure 6:
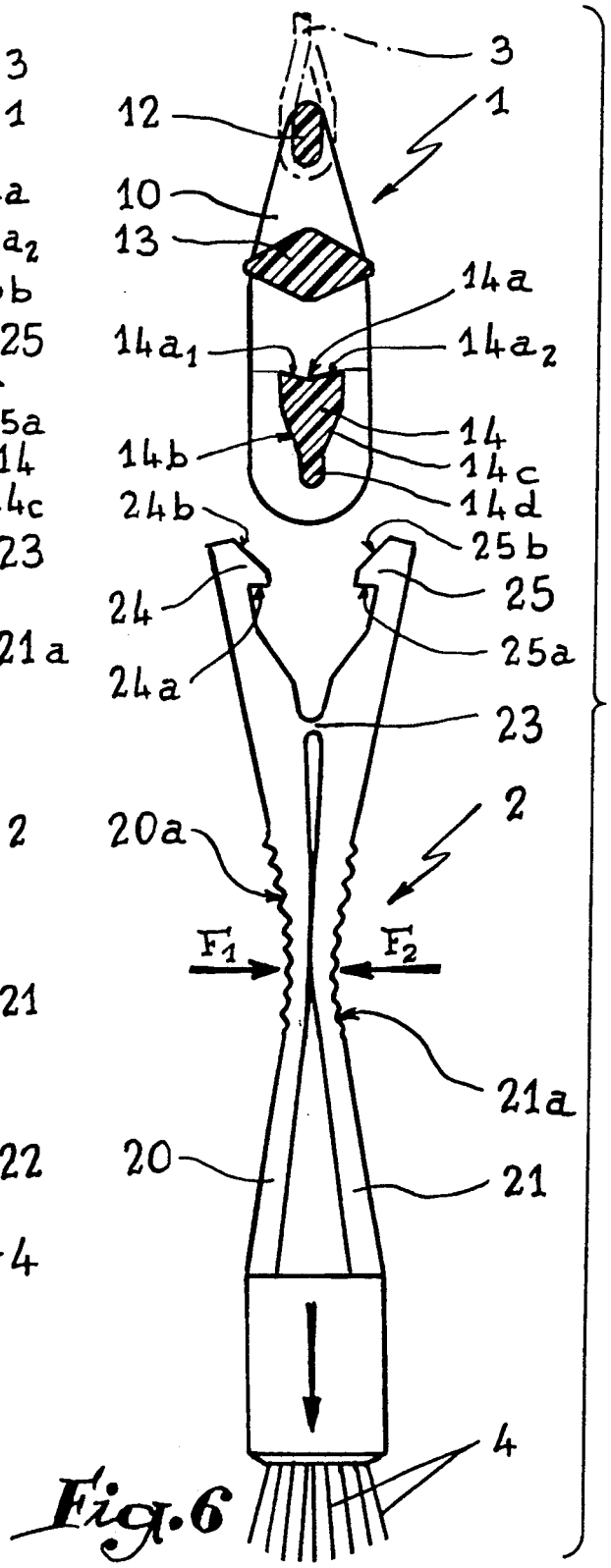

When it is desired, in a preferred application, to join multiple harness cords 4 with a cord 3, it suffices for the operator to grip the clamp 2 and to displace it towards the element so that the tongue **14*d* comes into engagement between the two hooks 24, 25. On continuing the relative movement of insertion of the clamp and the insert element, the tapered faces 24*b*, 25*b* of the ends of the hooks easily cooperate with the ramps 14*b*, 14*c* of the bar 14 of the insert element. In this way, the hooks move apart gradually, then, as soon as their faces 24***a*, 25*a* have moved beyond the edge 14*a*, they move towards each other due to the elasticity of the branch elements. When the operator releases the clamp 2, the hooks cooperate with the bar 14, as illustrated in FIG. 4. It will be observed that the forces developed on faces 24*a*, 25*b* of the hook by the faces $14a_1$, $14a_2$ of the edge 14*a* of the crosspiece 14 act on the branch elements with a tendency to approach the hooks so that the connection produced by the quick connect coupling between the cord 3 and the harness cords 4 is guaranteed to be of excellent quality.

If it is desired to uncouple the harness 4 and the cord 3, the operator merely has to press on the median parts of the branch element 20, 21 in the direction of arrows F1 and F2 in order to bring these elements closer together, so that the hooks are released from the bar 14. The elastic load applied on the harness cords 4 allows separation without any effort of the clamp and the insert element, these two elements then coming into the position shown in FIG. 6.

A two-element quick connect coupling has thus been produced, which is remarkably simple to assemble since the operator has only one operation to effect to bring the clamp and insert element together. The assembly is further facilitated by the taper of the inner surfaces of the cheeks 10 and 11, while the shape of the bar 14 ensures a perfect engagement of the clamp with respect to the insert element because of the automatic centering effected by the tongue 14*d* which is automatically introduced between the hooks, and to the inclines 24*b*, 25*b* of the hooks. In addition, uncoupling is effected by a simple pinching which is extremely rapid and without error.

Figure 7:
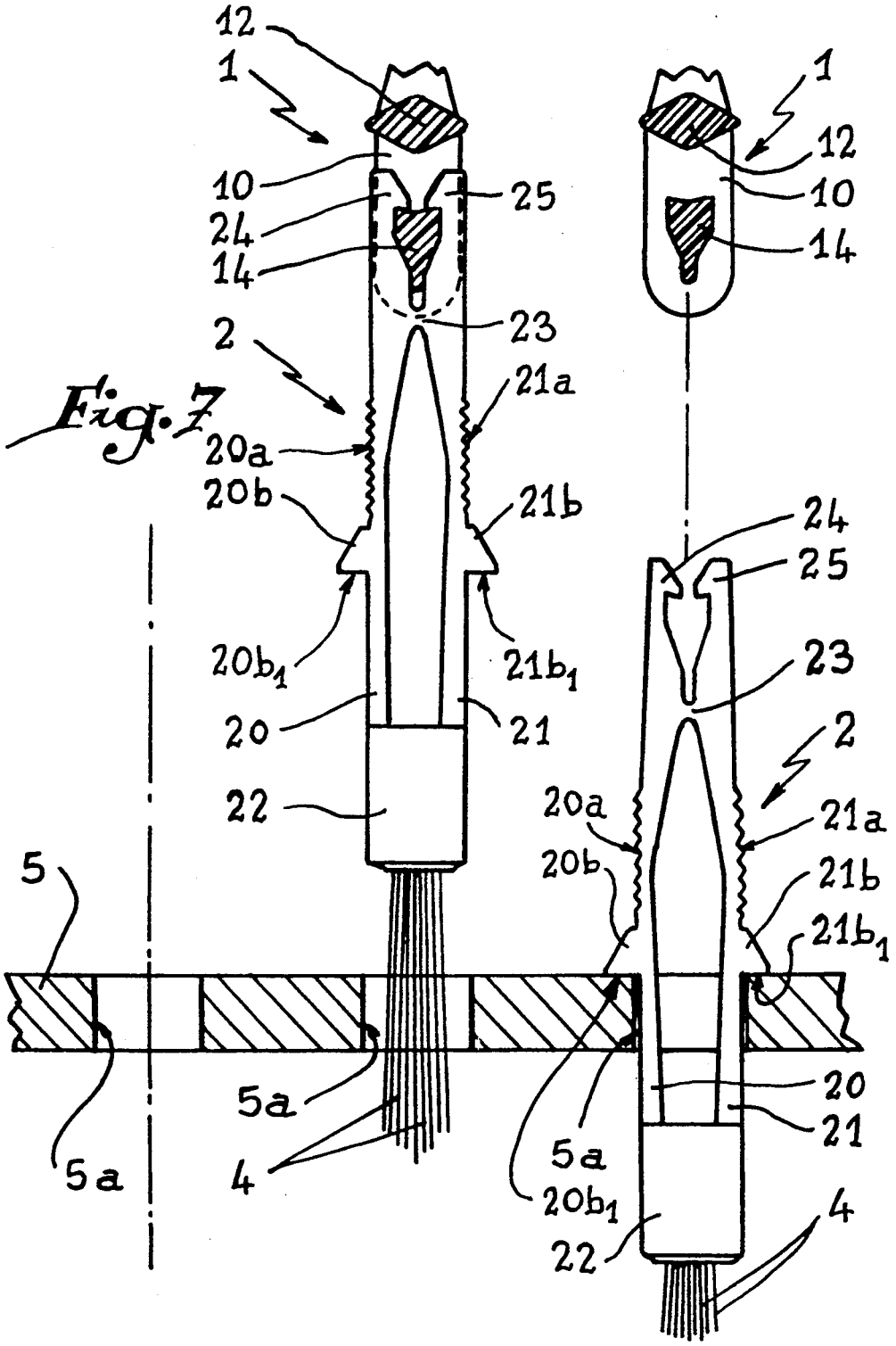
FIG. 7 is a view similar to that of FIG. 4 but illustrating a variant embodiment of the quick connect coupling according to the invention.

FIG. 7 illustrates another embodiment of the quick connect coupling according to the invention in a first position with the two elements joined at a second position with its two elements 1 and 2 separated. In accordance with this variant, the two branch element 20, 21 each include an outwardly projecting lug 20*b*, 21*b* disposed below their thin, striated median part 20*a*, 21*a*. These lugs each have a downwardly oriented horizontal face $20b_1$, $21b_1$.

The harness cords 4 are guided in conventional manner in holes 5*a* in a horizontal plate 5 above which the quick connect couplings 1–2 move to and fro without ever traversing the holes. Clamp element 2 is disconnected from insert element 1, the faces $20b_1$ and $21b_1$ of the lugs 20*b* and 21*b* rest against the plate 5 adjacent its holes. In this way, the harness is automatically maintained. It is observed that the diameters of the holes and the thickness of the lugs are such that, by pressing on the branches 20, 21 in the direction of arrows F1 and F2, clamp element 2 may be passed through the corresponding hole 5*a* of the plate 5, for example to dismantle the harness.

In particular, the insert element 1 may be directly molded on the cord 3.

We claim:

1. A quick connect coupling for connecting at least one funicular element with respect to an end of a harness cord of a weaving loom to a cord of a shed-forming device of the loom, wherein the coupling comprises; an insert element having a pair of opposing members which are connected by at least one cross-piece to which the cord of the shed-forming device may be attached and by a bar oriented in spaced relationship to said cross-piece, a clamp having two branch elements extending from a base to which at least one funicular element of the harness cord may be secured, said branch elements having opposing hooked free ends opposite said base, a flexible joint connecting said branch elements in spaced relationship from said hooked free ends, said hooked free ends being pivotable at said joint, and said branch elements having elastically yieldable intermediate portions between said base and said joint, whereby force applied to urge said intermediate portions towards one another will cause said opposing hooked ends to separate relative to one another to thereby permit the relative placement of said insert element therebetween.

2. The quick connect coupling of claim 1, in which said bar includes upper and lower portions, said lower portion including opposing inclined surfaces which are engagable between said hooked free ends of said clamp to thereby separate said hooked free ends relative to one another.

3. The quick connect coupling of claim 2, wherein said bar includes a lower tongue which extends outwardly relative to said inclined surfaces.

4. The quick connect coupling of claim 1, wherein said bar includes upper and lower surfaces, said upper surface having first and second portions which are tapered so as to be "V" shaped in configuration.

5. The quick connect coupling of claim 4, wherein each of said hooked free ends of said clamp include bearing surfaces, said bearing surfaces being complimentary in configuration to the upper surface of said bar.

6. The quick connect coupling of claim 1, including a guide plate having an opening therein through which said base and a portion of said branch elements extend, lug means extending outwardly from each of said branch elements between said intermediate portion and said base for engaging said guide plate to thereby limit the movement of said clamp relative to said guide plate.

7. The quick connect coupling of the claim 6, in which said opening in said guide plate is of a first dimension, said lugs extending outwardly relative to said branch elements a distance such that when said intermediate portions thereof are forced towards one another that said lugs will freely pass through said opening hole.

8. A quick connect coupling for connecting at least one element to another comprising; an insert element having a pair of opposing members which are connected by at least one cross-piece to which an element may be attached and by a bar oriented in spaced relationship to said cross-piece, a clamp having two branch elements extending from a base to which another element may be secured, said branch elements having opposing hooked free ends opposite said base, a flexible joint connecting said branch elements in spaced relationship from said hooked free ends, said hooked free ends being pivotable at said joint, and said branch elements having elastically yieldable intermediate portions between said base and said joint, whereby force applied to urge said intermediate portions towards one another will cause said opposing hooked ends to separate relative to one another to thereby permit the relative placement of said insert element therebetween.

9. The quick connect coupling of claim 8, in which said bar includes upper and lower portions, said lower portion including opposing inclined surface which are engagable between said hooked free ends of said clamp to thereby separate said hooked free ends relative to one another.

10. The quick connect coupling of claim 9, wherein said bar includes a lower tongue which extends outwardly relative to said inclined surfaces.

11. The quick connect coupling of claim 8, wherein said bar includes upper and lower surfaces, said upper surface having first and second portions which are tapered so as to be "V" shaped in configuration.

12. The quick connect coupling of claim 11, wherein each of said hooked free ends of said clamp include bearing surfaces, said bearing surfaces being complimentary in configuration to the upper surface of said bar.

* * * * *